US010438740B2

(12) United States Patent
Idogawa

(10) Patent No.: US 10,438,740 B2
(45) Date of Patent: Oct. 8, 2019

(54) IGNITION COIL DEVICE FOR INTERNAL COMBUSTION ENGINE

(71) Applicant: Mitsubishi Electric Corporation, Tokyo (JP)

(72) Inventor: Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/771,587

(22) PCT Filed: Feb. 26, 2016

(86) PCT No.: PCT/JP2016/055804
§ 371 (c)(1),
(2) Date: Apr. 27, 2018

(87) PCT Pub. No.: WO2017/145355
PCT Pub. Date: Aug. 31, 2017

(65) Prior Publication Data
US 2018/0350516 A1 Dec. 6, 2018

(51) Int. Cl.
*H01F 38/12* (2006.01)

(52) U.S. Cl.
CPC ..... *H01F 38/12* (2013.01); *H01F 2038/127* (2013.01)

(58) Field of Classification Search
CPC ..... H01F 38/12; H01F 2038/127
See application file for complete search history.

(56) References Cited

U.S. PATENT DOCUMENTS 5,170,767 A * 12/1992 Wada ..... F02P 13/00 123/169 PA
2002/0057179 A1* 5/2002 Shimada ..... H01F 27/327 336/208
2012/0299679 A1 11/2012 Kobayashi et al.

FOREIGN PATENT DOCUMENTS

JP 60-201607 A 10/1985
JP 10-294228 A 11/1998
(Continued)

OTHER PUBLICATIONS

International Search Report for PCT/JP2016/055804 dated May 10, 2016 [PCT/ISA/210].
(Continued)

*Primary Examiner* — Hieu T Vo
(74) *Attorney, Agent, or Firm* — Sughrue Mion, PLLC; Richard C. Turner

(57) ABSTRACT

Provided is an ignition coil device for an internal combustion engine, the device including: a plurality of side electrical steel cores which surround a primary coil and a secondary coil, and are divided at a division portion formed at a portion opposing the secondary coil; elastomeric materials respectively covering around the plurality of divided side electrical steel cores; and an insulating case housing the center electrical steel core, the primary coil, the secondary coil, the side electrical steel cores, and the elastomeric materials, and including an insulating resin injected and cured in an internal space thereof, wherein positions of secondary coil-side corner portions of division end portions which are end portions of the side electrical steel cores and the elastomeric materials on the division portion side are set to be different, in an axial direction of the secondary coil, from positions at which flanges of the secondary bobbin are disposed.

20 Claims, 3 Drawing Sheets

(56) References Cited

FOREIGN PATENT DOCUMENTS

| | | | | | |
|---|---|---|---|---|---|
| JP | 11204356 | A | * | 7/1999 | ..... H01F 38/12 |
| JP | 2005-019868 | A | | 1/2005 | |
| JP | 2012-248645 | A | | 12/2012 | |
| JP | 2015-109297 | A | | 6/2015 | |

OTHER PUBLICATIONS

Communication dated Aug. 21, 2018, from the Japanese Patent Office in counterpart application No. 2018-501524.

* cited by examiner

IGNITION COIL DEVICE FOR INTERNAL COMBUSTION ENGINE

CROSS REFERENCE TO RELATED APPLICATIONS

This application is a National Stage of International Application No. PCT/JP2016/055804 filed Feb. 26, 2016.

TECHNICAL FIELD

The present invention mainly relates to an ignition coil device that is mounted to an internal combustion engine for a vehicle, such as an internal combustion engine of an automobile, and causes spark discharge by supplying a high voltage to a spark plug.

BACKGROUND ART

In recent years, a need for improved fuel consumption has led to development of a vehicle intended to improve fuel consumption by increasing the engine (internal combustion engine) compression ratio, and a vehicle intended to improve fuel consumption through downsizing and the use of turbocharging.

With an increase in the compression ratio, it is necessary to increase the output voltage of the ignition coil device, and also to increase the withstand voltage inside the ignition coil device.

In addition, a method for improving fuel consumption by mounting an auxiliary machine may be adopted. This results in an additional limitation imposed on the mounting space of the ignition coil device, so that there is also a need for reducing the size and weight of the ignition coil device.

Accordingly, there is a demand for a small ignition coil device having a high output voltage and a high withstand voltage.

An ignition coil device for an internal combustion engine may be configured, for example, by winding a primary coil and a secondary coil around the outer circumference of a center electrical steel core (center core), and arranging a side electrical steel core (outer circumferential core) on the outside thereof.

These components are accommodated in an insulating case, and the insulation is maintained by filling the space inside the case with an insulating resin or the like.

Some ignition coil devices have a structure in which the side electrical steel core is covered around with an elastomeric material in order to relieve thermal cycle stress, and other ignition coil devices include divided side electrical steel cores for the purpose of ease of assembly, or insert a magnet at the divided position of the side electrical steel cores in order to enhance the magnetic efficiency.

At the division end portions of the side electrical steel cores and the division end portions of the elastomeric material, electric field concentration or thermal cycle stress concentration occurs, which may result in a reduction in insulation caused by the electric field concentration, detachment caused by the stress concentration, a reduction in insulation caused by cracks, or the like. Although the structure in which the side electrical steel core is covered around with the elastomeric material is effective in relieving thermal stress, the voltage endurance property of the elastomeric material itself is lower than that of an insulating filler such as an insulating resin.

The interface between the insulating resin and the secondary bobbin around which the secondary coil is wound has a withstand voltage inferior to that of the insulating resin or the secondary bobbin.

Moreover, in the case where detachment occurs between the elastomeric material and the insulating filler, the electric field is increased in an air layer formed by the detached portion. Therefore, it is necessary to ensure an insulation distance for a portion where the electric field is concentrated or a portion with a weak dielectric strength.

There is also a case where insulation has been increased, for example, by reducing the wall surface height of the secondary bobbin in order to prevent a size increase and ensure insulation (see Patent Document 1).

CITATION LIST

Patent Document

Patent Document 1: Japanese Laid-Open Patent Publication No. 2015-109297

SUMMARY OF THE INVENTION

Problems to be Solved by the Invention

However, as for the conventional ignition coil devices for an internal combustion engine, there is a concern that simply ensuring the insulation distance may lead to a size increase, and reducing the height of the secondary bobbin may result in formation of a portion having no wall for the winding portion of the secondary coil, so that irregular winding may occur, resulting in reduced insulation inside the winding.

The present invention has been proposed in view of the foregoing problems, and it is an object of the invention to provide an ignition coil device for an internal combustion engine that suppresses size increase, and ensures insulation between a secondary coil and a side electrical steel core without reducing the insulation in the secondary coil.

Solution to the Problems

An ignition coil device for an internal combustion engine according to the present invention includes: a primary coil wound around a tubular primary bobbin; a tubular secondary bobbin including a plurality of flanges formed in parallel at an axial interval; a secondary coil which is wound around a plurality of sections partitioned between the flanges of the secondary bobbin, and is disposed concentrically with the outer circumference of the primary coil; a center electrical steel core extending through the primary bobbin, and disposed concentrically with the primary coil and the secondary coil; a plurality of side electrical steel cores which surround the primary coil and the secondary coil so as to form a magnetic path together with the center electrical steel core, and are divided at a division portion formed at a portion opposing the secondary coil; elastomeric materials respectively covering around the divided side electrical steel cores; and an insulating case housing the center electrical steel core, the primary coil, the secondary coil, the side electrical steel cores, and the elastomeric materials, and including an insulating resin injected and cured in an internal space thereof, wherein positions of secondary coil-side corner portions of division end portions which are end portions of the side electrical steel cores and the elastomeric materials on the division portion side are set to be different, in an axial direction of the secondary coil, from positions at which the flanges of the secondary bobbin are disposed.

Effect of the Invention

With the ignition coil device for an internal combustion engine according to the present invention, the secondary coil-side corner portions of the division end portions, at which an electric field and stress are concentrated, of the side electrical steel cores and the elastomeric materials can be disposed away from the flange portions, where insulation is reduced, of the secondary bobbin, making it possible to prevent a size increase without reducing the size of the flanges of the secondary bobbin, and ensure a withstand voltage.

DESCRIPTION OF EMBODIMENTS

Embodiment 1

Hereinafter, the present invention will be described with reference to the drawings.

Figure 1:
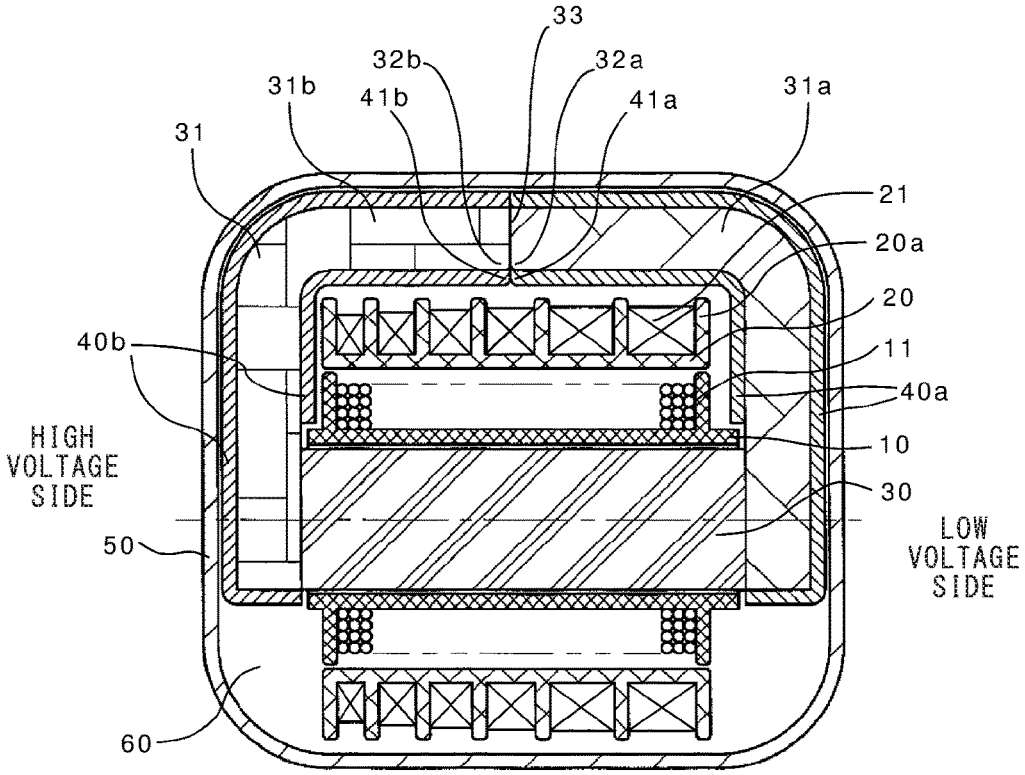
FIG. 1 is a cross-sectional view showing a main portion of an ignition coil device for an internal combustion engine according to Embodiment 1 of the present invention.
Figure 2:
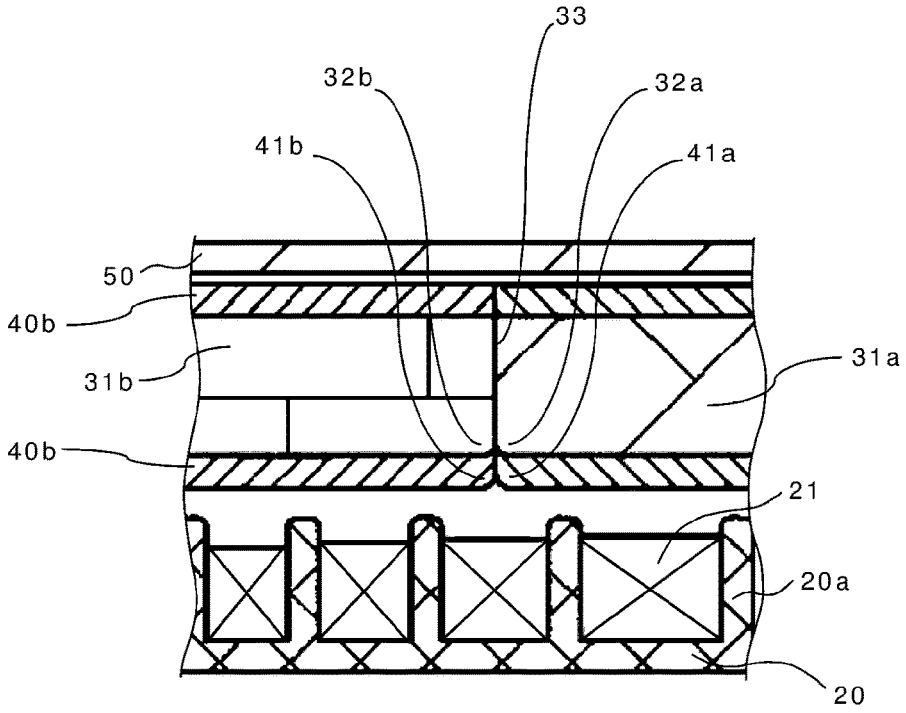
FIG. 2 is an enlarged cross-sectional view showing a main portion of FIG. 1.

FIGS. 1 and 2 are a cross-sectional view showing a main portion of an ignition coil device for an internal combustion engine according to Embodiment 1 of the present invention, and an enlarged cross-sectional view showing a main portion thereof.

In FIG. 1, a primary coil 11 wound around a tubular primary bobbin 10 is provided in an insulating case 50.

A tubular secondary bobbin 20 is provided on the outside of the primary bobbin 10, and a secondary coil 21 is wound around the secondary bobbin 20.

An I-shaped center electrical steel core 30 extends through the center of the primary bobbin 10, and the primary coil 11 and the secondary coil 21 are disposed concentrically with the center electrical steel core 30.

A side electrical steel core 31, which forms a magnetic path together with the center electrical steel core 30, forms a plurality of divided C-shaped side electrical steel cores, and is disposed so as to surround the primary coil 11 and the secondary coil 21.

To relieve thermal cycle stress, the outer circumference of the side electrical steel core 31 is covered with an elastomeric material 40 such as a thermosetting or thermoplastic elastomer.

In the insulating case 50, an insulating resin 60 such as a thermosetting epoxy resin is injected, and thereafter solidified.

Although not shown, as with the ignition coil device described in Japanese Laid-open Patent Publication No. 2010-27669, for example, the ignition coil device is provided with: an ignitor that is housed in the insulating case 50 and passes/interrupts a current to the primary coil 11; a low voltage side-connector that is provided integrally with the insulating case 50 and is electrically connected to the ignitor; a high voltage-side connector that is electrically connected to the spark plug; and so forth.

A driving signal from an external electronic control unit flows to the ignitor via the low voltage side-connector so as to control passage/interruption of a primary current flowing through the primary coil 11.

When the primary current flowing through the primary coil 11 in a predetermined ignition period of the internal combustion engine is interrupted by this driving signal, a counter electromotive force is generated in the primary coil 11, and a high voltage is generated in the secondary coil 21.

The generated high voltage is applied to the spark plug via the high voltage-side connector.

In FIG. 1, the secondary bobbin 20 around which the secondary coil 21 is wound includes a plurality of flanges 20*a* (seven flanges in the drawing) each of which is formed of an annular plate surrounding the outer circumference of the tubular base portion, and which are provided in parallel at a predetermined axial interval, and a plurality of sections (six sections in the drawing) are partitioned between adjacent flanges 20*a*.

The secondary coil 21 is wound in a divided manner for each of the sections partitioned by the flanges 20*a*, and is configured by repeatedly winding a predetermined number of turns of a copper wire with an insulating covering having a predetermined wire diameter, from the section at one axial end to the section at the other axial end.

Usually, the ignitor side (the right end side in FIG. 1) of the secondary coil 21 serves as a low voltage side, and the other end side (the left end side in FIG. 1) serves as a high voltage side.

In Embodiment 1, the side electrical steel core 31 is divided into two side electrical steel cores 31*a* and 31*b* by a division portion 33 formed at a portion opposing the secondary coil 21 in a direction parallel to the flanges 20*a* of the secondary bobbin 20. The side electrical steel cores 31*a* and 31*b* are covered with elastomeric materials 40*a* and 40*b*, respectively, around substantially the entire outer circumferences except for the end faces of the center electrical steel core 30.

The positions of corner portions (hereinafter referred to as "secondary coil-side corner portions") 32*a*, 32*b*, 41*a*, and 41*b*, opposing the secondary coil 21, of division end portions, which are end portions on the division portion 33 side, of the side electrical steel cores 31*a* and 31*b* and the elastomeric materials 40*a* and 40*b* are set near the middle of a third section of the secondary bobbin 20.

In addition, the corner portions 32*a*, 32*b*, 41*a*, and 41*b* of the division end portions of the side electrical steel cores 31*a* and 31*b* and the elastomeric materials 40*a* and 40*b* are formed so as to have an R-shape (see FIG. 2).

As described above, in the ignition coil device for an internal combustion engine according to Embodiment 1, the positions of the secondary coil-side corner portions 32*a*, 32*b*, 41*a*, and 41*b* of the division end portions of the two divided side electrical steel cores 31*a* and 31*b* and the elastomeric materials 40*a* and 40*b* covering the side electrical steel cores 31*a* and 31*b* are set near the middle of the third section of the secondary bobbin 20.

Accordingly, the secondary coil-side corner portions 32*a*, 32*b*, 41*a*, and 41*b*, at which an electric field and thermal cycle stress are concentrated, of the division end portions of the side electrical steel cores 31*a* and 31*b* and the elastomeric materials 40*a* and 40*b* can be spaced apart from the flanges 20*a* of the secondary bobbin 20 that are inferior in insulation to the insulating resin 60 so as to sufficiently ensure an insulation distance, thus making it possible to ensure insulation while preventing an undesirable size increase.

In addition, since the corner portions 32*a*, 32*b*, 41*a*, and 41*b* of the division end portions of the side electrical steel cores 31*a* and 31*b* and the elastomeric materials 40*a* and 40*b* have an R-shape, it is possible to prevent excessive electric field concentration and application of thermal cycle stress at these corner portions.

Note that although the positions of the secondary coil-side corner portions 32*a* and 32*b* of the side electrical steel cores 31*a* and 31*b* and the secondary coil-side corner portions 41*a* and 41*b* of the elastomeric materials 40*a* and 40*b* are set near the middle of the third section of the secondary bobbin 20 in Embodiment 1, the positions of the corner portions 32*a*, 32*b*, 41*a*, and 41*b* may be set in another section as long as they are set to be different, in the axial direction of the secondary coil 21, from the positions at which the flanges 20*a* of the secondary bobbin 20 are disposed.

Although the positions of the secondary coil-side corner portions 32*a* and 32*b* of the side electrical steel cores 31*a* and 31*b* and the secondary coil-side corner portions 41*a* and 41*b* of the elastomeric materials 40*a* and 40*b* are set in the same section of the secondary bobbin 20, they may be set in sections different from each other.

As described above, the ignition coil device for an internal combustion engine according to Embodiment 1 includes: a primary coil 11 wound around a tubular primary bobbin 10; a tubular secondary bobbin 20 including a plurality of flanges 20*a* formed in parallel at an axial interval; a secondary coil 21 which is wound around a plurality of sections partitioned between the flanges 20*a* of the secondary bobbin 20, and is disposed concentrically with the outer circumference of the primary coil 11; a center electrical steel core 30 extending through the primary bobbin 10, and disposed concentrically with the primary coil 11 and the secondary coil 21; a plurality of side electrical steel cores 31*a* and 31*b* which surround the primary coil 11 and the secondary coil 21 so as to form a magnetic path together with the center electrical steel core 30, and are divided at a division portion 33 formed at a portion opposing the secondary coil 21; elastomeric materials 40*a* and 40*b* respectively covering around the divided side electrical steel cores 31*a* and 31*b*; and an insulating case 50 housing the center electrical steel core 30, the primary coil 11, the secondary coil 21, the side electrical steel cores 31*a* and 31*b*, and the elastomeric materials 40*a* and 40*b*, and including an insulating resin 60 injected and cured in an internal space thereof. In the ignition coil device, the positions of the secondary coil-side corner portions 32*a*, 32*b*, 41*a*, and 41*b* of the division end portions which are end portions of the side electrical steel cores 31*a* and 31*b* and the elastomeric materials 40*a* and 40*b* on the division portion 33 side are set to be different, in an axial direction of the secondary coil 21, from positions at which the flanges 20*a* of the secondary bobbin 20 are disposed.

The ignition coil device for an internal combustion engine configured in this manner can ensure a sufficient distance from the flange portions, which are inferior in insulation to the insulating resin of the secondary bobbin, for the secondary coil-side corner portions, at which an electric field and thermal cycle stress are concentrated, of the division end portions of the side electrical steel cores and the elastomeric materials. Accordingly, it is possible to ensure insulation while preventing an undesirable size increase.

Embodiment 2

Figure 3:
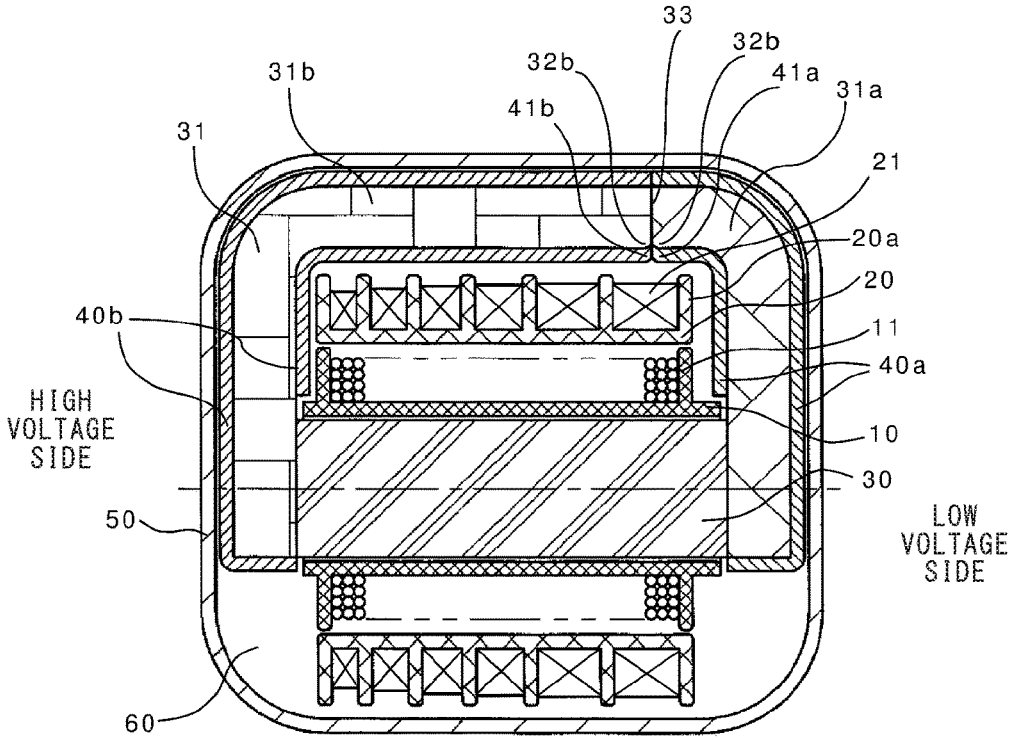
FIG. 3 is a cross-sectional view showing a main portion of an ignition coil device for an internal combustion engine according to Embodiment 2 of the present invention.

FIG. 3 is a cross-sectional view showing a main portion of an ignition coil device for an internal combustion engine according to Embodiment 2 of the present invention.

In Embodiment 2, as shown in FIG. 3, the positions of the secondary coil-side corner portions 32*a*, 32*b*, 41*a*, and 41*b* of the division end portions of the side electrical steel cores 31*a* and 31*b* and the division end portions of the elastomeric materials 40*a* and 40*b* covering the side electrical steel cores 31*a* and 31*b* are set near the middle of a first section of the secondary bobbin 20. The rest of the configuration is the same as that of Embodiment 1.

The ignition coil device for an internal combustion engine configured in the above-described manner has the lowest potential in the first section (low voltage side) of the secondary bobbin 20. Accordingly, even when an electric field is concentrated at the secondary coil-side corner portions 32*a*, 32*b*, 41*a*, and 41*b*, the voltage will not exceed the withstand voltage of the insulating resin, making it possible to ensure insulation without a size increase.

Usually, when leveling of the potential distribution of the secondary coil 21 is taken into consideration, the first section of the secondary bobbin 20 has the largest width, and, therefore, it is also possible to easily ensure the distance from the flanges 20 of the secondary bobbin 20 while ensuring the withstand voltage of the secondary coil 21.

Embodiment 3

Figure 4:
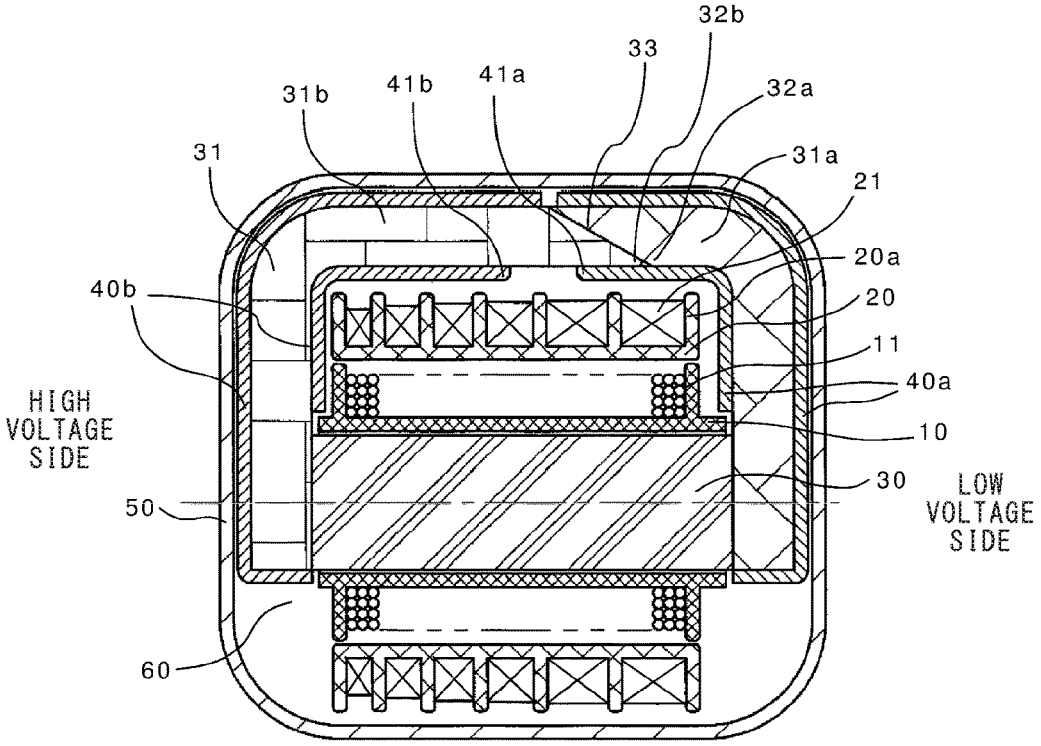
FIG. 4 is a cross-sectional view showing a main portion of an ignition coil device for an internal combustion engine according to Embodiment 3 of the present invention.

FIG. 4 is a cross-sectional view showing a main portion of an ignition coil device for an internal combustion engine according to Embodiment 3 of the present invention.

In Embodiment 3, as shown in FIG. 4, the division portion 33 of the side electrical steel core 31 is formed as an oblique side inclined relative to the flanges 20*a* of the secondary bobbin 20, and the positions of the secondary coil-side corner portions 32*a* and 32*b* of the side electrical steel cores 31*a* and 31*b* are set near the middle of the first section of the secondary bobbin 20.

In addition, the position of the secondary coil-side corner portion 41*a* of the division end portion of the elastomeric material 40*a* covering the side electrical steel core 31*a* is set near the middle of a second section of the secondary bobbin 20, and the position of the secondary coil-side corner portion 41*b* of the division end portion of the elastomeric material 40*b* covering the side electrical steel core 31*b* is set near the middle of the third section of the secondary bobbin 20.

In general, the thickness of an elastomeric material is set to be about 0.5 mm to 1.5 mm, and the sum of the width of each section and the flange thickness of the secondary bobbin 20 is set to be 1.5 mm or more even on the high voltage side, which has the smallest thickness. Accordingly, by providing the secondary coil-side corner portions 41*a* and 41*b* of the division end portions of the elastomeric materials 40*a* and 40*b* in different sections of the secondary bobbin 20, the distance between the division end portions of the elastomeric materials 40*a* and 40*b* (hereinafter referred to as "inter-division distance") can be increased relative to the thickness of the elastomeric materials.

In the present embodiment, by setting the thickness of the elastomeric materials 40*a* and 40*b* to be about 1.0 mm, and setting the secondary coil-side corner portion 41*a* near the middle of the second section and the secondary coil-side corner portion 41*b* near the middle of the third section, the elastomeric materials 40*a* and 40*b* have an inter-division distance of about 5.0 mm, and thus are configured to have an inter-division distance greater than or equal to the thickness of the elastomeric materials 40*a* and 40*b*. The rest of the configuration is the same as that of Embodiment 1.

In the case of covering the divided side electrical steel cores 31*a* and 31*b* with the elastomeric materials 40*a* and 40*b*, variations in distance between the elastomeric materials occur owing to variations in size of the side electrical steel cores 31*a* and 31*b* and the elastomeric materials 40*a* and 40*b*, or shrinkage thereof after molding. If these variations occur, it is also necessary to prevent a gap from being formed between the division end portions of the side electrical steel cores 31*a* and 31*b* (prevent the elastomeric materials from coming into contact with each other before the side electrical steel cores). In addition, depending on the variations, a gap may be formed between the elastomeric materials, resulting in a narrow insulating resin layer formed between the elastomeric materials.

However, the elastomeric material and the insulating resin have different coefficients of linear expansion, and, therefore, thermal cycle stress is applied to the insulating resin layer. If this portion does not have sufficient strength, there is a concern that cracks may occur.

Therefore, as in Embodiment 3, with a configuration in which at least an inter-division distance greater than or equal to the thickness of the elastomeric materials 40*a* and 40*b* is provided between the division end portions of the elastomeric materials 40*a* and 40*b* covering the side electrical steel cores 31*a* and 31*b*, it is possible to prevent a decrease in the thickness of the insulating resin layer that is injected between the elastomeric materials and is then cured. Accordingly, the likelihood of occurrence of cracks in the insulating resin layer upon application of thermal cycle stress is reduced, making it possible to prevent a reduction in insulation upon application of thermal cycle stress.

By setting the positions of the secondary coil-side corner portions 31*a*, 31*b*, 41*a*, and 41*b* of the division end portions of the side electrical steel cores 31*a* and 31*b* and the elastomeric materials 40*a* and 40*b* to be located in different sections of the secondary bobbin 20 as in Embodiment 3, even in the case of using a secondary bobbin including narrow sections, a sufficient division distance can be maintained between the flanges of the secondary bobbin and the division end portions of the side electrical steel cores and the division end portions of the elastomeric materials, making it possible to prevent an undesirable size increase and ensure the durability.

Since the division portion 33 of the side electrical steel core 31 is formed as an oblique side in Embodiment 3, the gap length is the same level between division end portions for both a cross section with a vertical plane and a cross section with an inclined plane, whereas the cross-sectional area of the magnetic circuit increases, making it possible to suppress an increase in magnetic resistance due to variations in components.

In Embodiment 3, the division portion 33 of the side electrical steel core 31 is formed to be inclined from the first section to the second section of the secondary bobbin 20, the position of the secondary coil-side corner portion 41*a* of the division end portion of the elastomeric material 40*a* is set near the middle of the second section of the secondary bobbin 20, and the position of the secondary coil-side corner portion 41*b* of the division end portion of the elastomeric material 40*b* is set near the middle of the third section of the secondary bobbin 20. However, each of these positions may be set at a position corresponding to a different section as long as a configuration in which a gap is formed between the division end portions of the elastomeric materials 40*a* and 40*b* is adopted.

Embodiment 4

Figure 5:
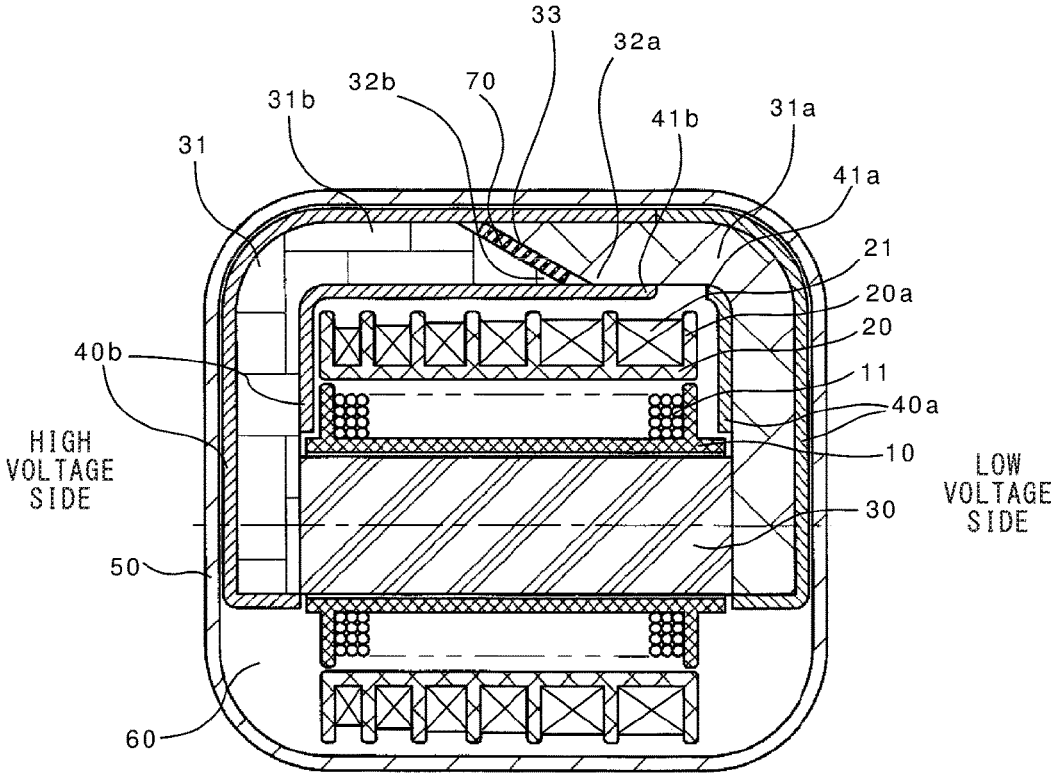
FIG. 5 is a cross-sectional view showing a main portion of an ignition coil device for an internal combustion engine according to Embodiment 4 of the present invention.
Figure 6:
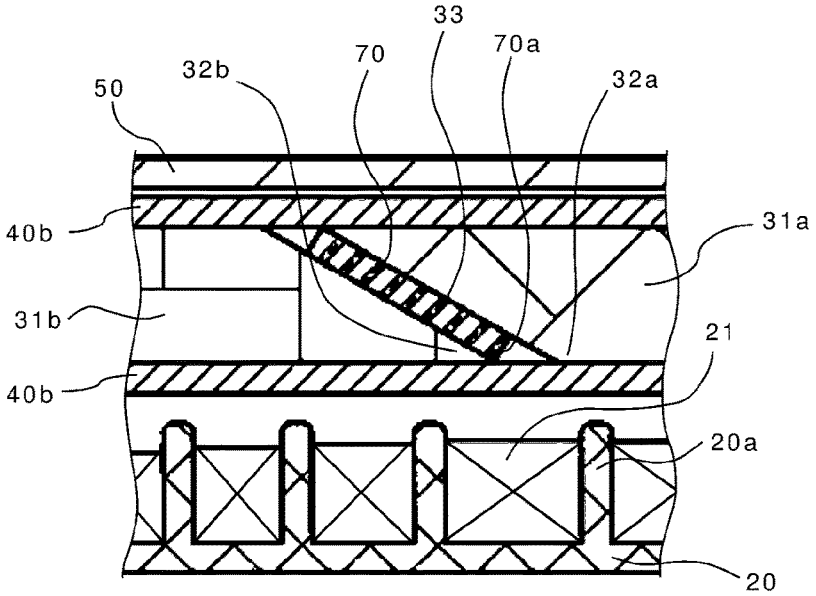
FIG. 6 is an enlarged cross-sectional view showing a main portion of FIG. 5.

FIGS. 5 and 6 are a cross-sectional view showing a main portion of an ignition coil device for an internal combustion engine according to Embodiment 4 of the present invention, and an enlarged cross-sectional view showing a main portion thereof.

In Embodiment 4, as shown in FIG. 5, the division portion 33 of the side electrical steel core 31 is formed as an oblique side inclined relative to the flange 20*a* of the secondary bobbin 20 from the second section to the third section of the secondary bobbin 20, a magnet 70 for enhancing the magnetic efficiency is inserted in the division portion 33 of the side electrical steel core 31, and an edge portion 70*a* of the magnet 70 on the side opposing the secondary coil is disposed so as to be located inward of the surface of the side electrical steel core 31*a* opposing the secondary coil (on the side further away from the secondary coil 21) (see FIG. 6).

The positions of the secondary coil-side corner portions 32*a* and 32*b* of the division end portions of the side electrical steel cores 31*a* and 31*b* are set near the middle of the second section of the secondary bobbin 20.

Furthermore, the position of the secondary coil-side corner portion 41*b* of the division end portion of the elastomeric material 40*b* covering the side electrical steel core 31*a* is set in the first section, and the position of the secondary coil-side corner portion 41*a* of the division end portion of the elastomeric material 40*a* of the secondary bobbin 20 is set outside the wall surface of the secondary bobbin 20 at the end of the low voltage-side section, thus ensuring a large inter-division distance for the division end portions of the elastomeric materials 40*a* and 40*b*.

Furthermore, the angle of the secondary coil-side corner portion 32*b* of the division end portion of the side electrical steel core 31*b* is made acute as compared with the angle of the secondary coil-side corner portion 32*a* of the division end portion on the side electrical steel core 31*a* side.

Furthermore, a configuration is adopted in which the elastomeric material 40*b* covers entirely around the corners of the side electrical steel core 31*b* and the magnet 70, and the circumference of the assembly surface of the magnet 70 is surrounded by the elastomeric material 40*b*. The rest of the configuration is the same as that of Embodiment 1.

In the ignition coil device for an internal combustion engine configured in the above-described manner, the edge portion 70*a* of the magnet 70 that is inserted in the division portion 33 of the side electrical steel core 31 is located inward of the surface of the side electrical steel core (on the side further away from the secondary coil 21). Accordingly, the magnet 70 will not protrude from the surface of the side electrical steel core at the time of assembly of the magnet 70, making it possible to ensure an insulation distance even when an electric field is concentrated at the edge portion of the magnet 70.

In Embodiment 4, the division portion 33 of the side electrical steel core 31 is formed as an oblique side, and the magnet 70 is inserted in the division portion 33 of the side electrical steel core 31. Accordingly, the cross-sectional area of the magnetic circuit is increased, making it possible to suppress an increase in magnetic resistance caused by variations in components. Moreover, there is an advantage of ease of insertion of a magnet having a large area, in the division portion.

In Embodiment 4, the secondary coil-side corner portions 32*a* and 32*b* of the division end portions of the side electrical steel cores 31*a* and 31*b* are configured such that the angle on the side electrical steel core 31*b* side, which is closer to the flange of secondary bobbin 20 on the high voltage side, is made acute as compared with the angle on the side electrical steel core 31*a* side, which is closer to the flange of the secondary bobbin 20 on the low voltage side, and are disposed such that the distance to the flanges 20*a* of the secondary bobbin 20 from the secondary coil-side corner portion 32*b* on the acute angle side is slightly larger than the distance thereto from the secondary coil-side corner portion 32*a* on the obtuse angle side. Accordingly, it is possible to ensure the distance between the side electrical steel core 31*b* on the acute angle side where a large electric field or thermal cycle stress is applied, and the flanges 20*a* of the secondary bobbin 20 that have poor insulation resistance.

Furthermore, a configuration is adopted in which the elastomeric material 40*b* covers entirely around the corners of the side electrical steel core 31*b* and the magnet 70, and it is therefore possible to relieve the thermal cycle stress entirely around the corners of the side electrical steel core 31*b* and the magnet 70.

Since a configuration is adopted in which the circumference of the assembly surface of the magnet 70 is surrounded by the elastomeric material 40*b*, the elastomeric material 40*b* enhances the ease of assembly by serving the function for positioning at the time of assembly of the magnet 70, making it also possible to prevent the magnet 70 from moving to the secondary coil 21 side during assembly.

In Embodiment 4, the division portion 33 of the side electrical steel core 31 is formed to be inclined from the second section to the third section of the secondary bobbin 20, the position of the secondary coil-side corner portion 41*b* of the division end portion of the elastomeric material 40*b* is set near the middle of the first section of the secondary bobbin 20, and the position of the corner portion 41*a* of the division end portion of the elastomeric material 40*a* opposing the secondary coil is set outside the wall surface at the end of the low voltage-side section of the secondary bobbin 20. However, a configuration in which the magnet is not covered with the elastomeric material can also eliminate the problem of a reduction in insulation caused by detachment and cracking during the occurrence of electric field concentration and thermal cycle stress, as long as the magnet will not protrude from the surface of the side electrical steel core to the secondary coil side.

A configuration in which the elastomeric material covers the magnet can serve the function for preventing the positional shift for the magnet. Accordingly, the dividing position of the elastomeric material may be located in a different section of the secondary bobbin.

It is noted that, although the embodiments of the present invention have been described above, the present invention is not limited to the embodiments given above. Various design changes can be made, and the embodiments may be freely combined, or each of the embodiments may be modified or omitted as appropriate within the scope of the invention.

DESCRIPTION OF THE REFERENCE CHARACTERS

10 primary bobbin
11 primary coil
20 secondary bobbin
20*a* flange
21 secondary coil
30 center electrical steel core
31, 31*a*, 31*b* side electrical steel core
32*a*, 32*b* secondary coil-side corner portion
33 division portion
40, 40*a*, 40*b* elastomeric material
41*a*, 41*b* secondary coil-side corner portion
50 insulating case
60 insulating resin
70 magnet
70*a* edge portion of magnet

The invention claimed is:

1. An ignition coil device for an internal combustion engine, the device comprising:

a primary coil wound around a tubular primary bobbin;

a tubular secondary bobbin including a plurality of flanges formed in parallel at an axial interval;

a secondary coil which is wound around a plurality of sections partitioned between the flanges of the secondary bobbin, and is disposed concentrically with an outer circumference of the primary coil;

a center electrical steel core extending through the primary bobbin, and disposed concentrically with the primary coil and the secondary coil;

a plurality of side electrical steel cores which surround the primary coil and the secondary coil so as to form a magnetic path together with the center electrical steel core, and are divided at a division portion formed at a portion opposing the secondary coil;

elastomeric materials respectively covering around the divided side electrical steel cores; and an insulating case housing the center electrical steel core, the primary coil, the secondary coil, the side electrical steel cores, and the elastomeric materials, and including an insulating resin injected and cured in an internal space thereof, wherein positions of secondary coil-side corner portions of division end portions which are end portions of the side electrical steel cores and the elastomeric materials on the division portion side are set to be different, in an axial direction of the secondary coil, from positions at which the flanges of the secondary bobbin are disposed.

2. The ignition coil device for an internal combustion engine according to claim 1, wherein positions of the secondary coil-side corner portions of the division end portions of the side electrical steel cores and the elastomeric materials are set so as to correspond to a low voltage-side section of the secondary bobbin.

3. The ignition coil device for an internal combustion engine according to claim 2, wherein the division end portions of the elastomeric material covering the side electrical steel cores have an inter-division distance greater than or equal to a thickness of the elastomeric materials.

4. The ignition coil device for an internal combustion engine according to claim 3, comprising a magnet inserted between the division end portions of the side electrical steel cores, wherein an edge portion of the magnet on a side opposing the secondary coil is disposed so as to be located at a position further away from the secondary coil than surfaces of the side electrical steel cores opposing the secondary coil.

5. The ignition coil device for an internal combustion engine according to claim 4, wherein the secondary coil-side corner portions of the division end portions of the side electrical steel cores and the elastomeric materials have an R-shape.

6. The ignition coil device for an internal combustion engine according to claim 3, wherein the secondary coil-side corner portions of the division end portions of the side electrical steel cores and the elastomeric materials have an R-shape.

7. The ignition coil device for an internal combustion engine according to claim 2, comprising a magnet inserted between the division end portions of the side electrical steel cores, wherein an edge portion of the magnet on a side opposing the secondary coil is disposed so as to be located at a position further away from the secondary coil than surfaces of the side electrical steel cores opposing the secondary coil.

8. The ignition coil device for an internal combustion engine according to claim 7, wherein the secondary coil-side corner portions of the division end portions of the side electrical steel cores and the elastomeric materials have an R-shape.

9. The ignition coil device for an internal combustion engine according to claim 2, wherein the secondary coil-side corner portions of the division end portions of the side electrical steel cores and the elastomeric materials have an R-shape.

10. The ignition coil device for an internal combustion engine according to claim 2, wherein the division portion of the side electrical steel cores is formed as an oblique side inclined relative to the flanges of the secondary bobbin.

11. The ignition coil device for an internal combustion engine according to claim 1, wherein the division end portions of the elastomeric material covering the side electrical steel cores have an inter-division distance greater than or equal to a thickness of the elastomeric materials.

12. The ignition coil device for an internal combustion engine according to claim 11, comprising a magnet inserted between the division end portions of the side electrical steel cores, wherein an edge portion of the magnet on a side opposing the secondary coil is disposed so as to be located at a position further away from the secondary coil than surfaces of the side electrical steel cores opposing the secondary coil.

13. The ignition coil device for an internal combustion engine according to claim 12, wherein the secondary coil-side corner portions of the division end portions of the side electrical steel cores and the elastomeric materials have an R-shape.

14. The ignition coil device for an internal combustion engine according to claim 11, wherein the secondary coil-side corner portions of the division end portions of the side electrical steel cores and the elastomeric materials have an R-shape.

15. The ignition coil device for an internal combustion engine according to claim 11, wherein the division portion of the side electrical steel cores is formed as an oblique side inclined relative to the flanges of the secondary bobbin.

16. The ignition coil device for an internal combustion engine according to claim 1, comprising a magnet inserted between the division end portions of the side electrical steel cores, wherein an edge portion of the magnet on a side opposing the secondary coil is disposed so as to be located at a position further away from the secondary coil than surfaces of the side electrical steel cores opposing the secondary coil.

17. The ignition coil device for an internal combustion engine according to claim 16, wherein the secondary coil-side corner portions of the division end portions of the side electrical steel cores and the elastomeric materials have an R-shape.

18. The ignition coil device for an internal combustion engine according to claim 1, wherein the secondary coil-side corner portions of the division end portions of the side electrical steel cores and the elastomeric materials have an R-shape.

19. The ignition coil device for an internal combustion engine according to claim 1, wherein the division portion of the side electrical steel cores is formed as an oblique side inclined relative to the flanges of the secondary bobbin.

20. The ignition coil device for an internal combustion engine according to claim 19, wherein the secondary coil-side corner portions of the division end portions of the side electrical steel cores are disposed such that a distance to the flanges of the secondary bobbin from the secondary coil-side corner portion on an acute angle side is larger than a distance thereto from the secondary coil-side corner portion on an obtuse angle side.

* * * * *